United States Patent [19]

Matsumura et al.

[11] Patent Number: 4,808,475

[45] Date of Patent: Feb. 28, 1989

[54] HIGHLY ELECTROCONDUCTIVE GRAPHITE CONTINUOUS FILAMENT AND PROCESS FOR PREPARATION THEREOF

[75] Inventors: Kiichiro Matsumura, Nara; Akio Takahashi, Kusatsu; Jun Tsukamoto, Otsu, all of Japan

[73] Assignee: Director-General of Agency of Industrial Science & Technology, Tokyo, Japan

[21] Appl. No.: 12,840

[22] Filed: Feb. 10, 1987

Related U.S. Application Data

[62] Division of Ser. No. 596,549, Apr. 4, 1984, Pat. No. 4,666,736.

[30] Foreign Application Priority Data

Apr. 5, 1983 [JP] Japan ..... 58-58734

[51] Int. Cl.[4] ..... D02G 3/00

[52] U.S. Cl. ..... 428/367; 423/447.1; 423/447.2; 423/448; 423/460; 428/408; 428/375

[58] Field of Search ..... 428/367, 408; 423/447.1, 460, 448, 439, 447.2

[56] References Cited

U.S. PATENT DOCUMENTS

| | | | |
|---|---|---|---|
| 4,388,227 | 6/1983 | Kalnin | 423/460 X |
| 4,435,375 | 3/1984 | Tamura et al. | 423/439 |
| 4,518,632 | 5/1985 | Jones | 428/367 X |

OTHER PUBLICATIONS

Y. Shibata et al., Muki-Kagaku-Zensho (Complete Works of Inorganic Chemistry), X-2, pp. 252-255 together with partial translation. Certified copy of U.S. Ser. No. 393,136, filed 8/31/64.

*Primary Examiner*—Lorraine T. Kendell

*Attorney, Agent, or Firm*—Austin R. Miller

[57] ABSTRACT

A highly electroconductive graphite continuous filament is described, which is composed of a carbon filament as a substrate and a graphite layer having a layer spacing d (0,0,2) of not larger than 3.363 angstroms as an outer skin layer The graphite continuous filament is prepared by depositing easily graphitizable carbon on the substrate and heat-treating the carbon-deposited substrate at a temperature of at least 2,500° C.

11 Claims, No Drawings

HIGHLY ELECTROCONDUCTIVE GRAPHITE CONTINUOUS FILAMENT AND PROCESS FOR PREPARATION THEREOF

RELATED APPLICATION

This is a division of our U.S. patent application Ser. No. 596,549, filed on Apr. 4, 1984, now U.S. Pat. No. 4,666,736.

BACKGROUND OF THE INVENTION (1) Field of the Invention

This invention relates to a highly electroconductive graphite continuous filament and a process for preparing the same.

(2) Description of the Prior Art

Electrically conductive metals such as metallic copper and aluminum have heretofore been used as electrically conductive materials. However, resources of these metals will be exhausted at some time or other, and development of electroconductive materials that can be used as substitutes for these metals has been desired. Furthermore, since metals have a high specific gravity, in the field where light weight characteristics are required, development of a light electroconductive material is desired. Moreover, metals are corrosive, and hence, the application fields are limited. Accordingly, development of anti-corrosive electroconductive materials has long been desired. Still further, since metal conductors have a relatively low melting point, they cannot be used at a very high temperature. Therefore, development of electroconductive materials that can be used at a super-high temperature has been desired. An electroconductive material satisfying these requirements should have an electric conductivity of at least $1.0\times10^4$ S/cm, preferably at least $5.0\times10^4$ S/cm, should be flexible, stable, light and anti-corrosive and should resist a high temperature and be in the form of continuous filament.

It is known that graphite has a high electric, conductivity. However, graphite is obtained only in the form of a small piece, and is not suitable for use as an electroconductive material.

A carbon fiber has a filamentary shape suitable for industrial purposes, but the electric conductivity is low, i.e., about $6\times10^2$ to about $1\times10^3$ S/cm at 20° C. Even if it is calcined at a temperature higher than 3,000° C., the electric conductivity is about $2\times10^3$ S/cm and the calcined product is still not suitable as an electroconductive material.

It has been reported that a graphite fiber was manufactured according to the gas phase growth method [A. Oberlin, Carbon 14, 133 (1976)]. However, in this manufacturing method, the fiber can be obtained only in a short fiber form having a length of about 25 cm at longest, and the electric conductivity is inevitably reduced at joints of fibers and thus, the fiber does not meet the afore-mentioned demands. As means for preparing a carbon-carbon composite, there has been proposed a method in which carbon is deposited on carbon staple fibers or a woven fabric of carbon fibers by CVD (chemical vapor deposition) and the carbon staple fibers or woven fabric is then heat-treated. In the product obtained according to this method, carbon fibers are fusion-bonded to one another and therefore, the product has poor flexibility and cannot be used as an electroconductive material. Moreover, even if calcination is carried out at such a high temperature as about 3,000° C., the electric conductivity of the composition obtained according to this method is as low as about $3\times10^3$ S/cm (see, for example, page 84 of International Symposium on Carbon, Toyohashi, 1982), and the composition is not suitable as an electroconductive material. This fact is very important and indicates that even if carbon deposited by the CVD method is calcined at a high temperature, the electric conductivity is not necessarily highly improved. Japanese Examined Patent Publication No. 41-12,091 proposes a method for preparing a carbon fiber by thermal decomposition of benzene. However, the electric conductivity of the fiber obtained according to this method is as low as about $2\times10^3$ S/cm and the fiber length is about 10 cm at longest.

SUMMARY OF THE INVENTION

It is a primary object of the present invention to provide a novel electroconductive material composed of an anti-corrosive filament, which has a high electric conductivity, a good stability and a good flexibility and can be used at a high temperature.

In accordance with the present invention, there is provided a highly electroconductive graphite continuous filament comprising a carbon filament as a substrate and a graphite layer having a layer spacing d (0,0,2) of not larger than 3.363 angstroms as an outer skin layer.

DESCRIPTION OF THE PREFERRED EMBODIMENTS

Important terms will be described before starting the detailed description of the invention.

In the field of carbon materials and carbon fibers, the term "graphite" is used either in a narrow sense or in a broad sense.

In the narrow sense, graphite is defined as follows:

A compound composed mainly of carbon, in which the structure of planes consisting of 6-membered ring carbons bonded through $SP_2$ bonds and being bonded through van der Waals bonds is developed and the spacing d determined from the (002) diffraction line by the X-ray diffractiometry is not larger than 3.363 angstroms.

In the broad sense, graphite is defined as follows:

A carbon material obtained by calcination at a temperature of at least about 2,000° C., in which the graphite structure according to the narrow sense need not be developed.

In the present invention, the term "graphite" is used in the above-mentioned narrow sense, unless otherwise indicated. For example, a carbon fiber is a hardly graphitizable fiber, and even if this fiber is calcined at a temperature of higher than 3,000° C., graphite in the narrow sense is not formed. Accordingly, the term "graphite fiber" appearing in literature references does not always mean the kind of graphite referred to in the present invention.

In the present invention, the layer spacing (0,0,2) of graphite is determined according to the method described in Example 1 given hereinafter, and the electric conductivity is determined according to the conventional four-terminal method.

In the present invention, a carbon filament is used as the fibrous substrate on which the graphite continuous filament having a graphite layer as the outer skin layer is formed. Various carbon filaments are used as the substrate in the present invention. For example, there can be mentioned a carbon filament obtained by calcining polyacrylonitrile, a pitch type carbon filament obtained from pitch, a carbon filament synthesized by calcining cellulose, a carbon filament prepared from Vinylon, a lignin/polyvinyl alcohol type carbon filament and carbon filaments prepared according to other methods. These carbon filaments are roughly divided into flame-retardant filaments obtained by calcination at about 300 to about 500° C., carbonaceous filaments synthesized at a carbonization temperature of about 800° to about 1,500° C. and filaments obtained by calcination at a temperature of at least about 2,000° C.

Any of these three kinds of carbon filaments can be, used as the substrate in the present invention. Particularly, a carbonaceous filament and a filament obtained by calcination at a temperature of at least about 2,000° C. are preferred. Of course, other carbon filaments may be used in the present invention. Moreover, carbon filaments obtained by modifying the surfaces of the foregoing carbon continuous filaments according to various methods can be used in the present invention. The fibrous substrate should be in the form of a continuous filament in order to prepare the graphite continuous filament of the present invention which is used as an electroconductive polymer. In case of a staple fiber, if it is intended to be used as an electroconductive material having a length exceeding the length of the short fiber joining of fibers becomes necessary and the electric conductivity is reduced at the joints. Namely, even if the electric conductivity of one fiber is very high, the electric conductivity is reduced at joints and the staple fiber has no industrial value as an electroconductive material. In the present invention, the electroconductive carbon continuous filament has a length of at least 1 m, preferably at least 5 m, more preferably at least 10 m. A continuous filament generally called "an endless filament" is especially preferred. A fine filament diameter is preferred, but since preparation of a filament having a very fine diameter is difficult, a filament having a diameter of 5 to 10 μm is ordinarily used, though the filament diameter is not particularly, limited within this range.

In order to attain a high electric conductivity, it is indispensable that the spacing of graphite covering the fibrous substrate as the outer skin layer, should be not larger than 3.363 angstroms. It is known that carbon may be deposited on a carbon fiber so as to improve the strength and other characteristics. However, carbon deposited according to this known method is not graphitized and the electric conductivity is low. Accordingly, this conventional method is different from the present invention.

Easily graphitizable carbon used in the present invention can be synthesized from various aliphatic hydrocarbons, aromatic hydrocarbons and alicyclic hydrocarbons, and derivatives of these hydrocarbons. For example, there can be mentioned compounds such as benzene, toluene, xylene, naphthalene, 1-octyne, 2,4-hexadiyne, acetonitrile, tetracyanoethylene, phenylacetylene, heptane, cyclohexane, propagyl alcohol, acetylene and methylacetylene. Furthermore, organic compounds having 3 to 6 carbon atoms and having a cyano group and an ethylenically or acetylenically unsaturated bond can be used. More specifically, there can be mentioned hydrocarbons having 3 to 6 carbon atoms and having a cyano group and a carbon-to-carbon triple bond, such as cyanoacetylene and dicyanoacetylene, and organic compounds having 3 to 6 carbon atoms and having a cyano group and a carbon-to-carbon double bond, which are represented by the following general formula:

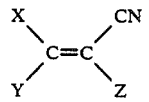

wherein X, Y and Z independently represent a hydrogen atom, a halogen atom, a cyano group or an alkyl group, such as acrylonitrile, methacrylonitrile, tetracyanoethylene and chloroacrylonitrile. Aromatic hydrocarbons and derivatives thereof are preferably used, and a compound having a cyano group and an acetylene group, such as cyanoacetylene or dicyanoacetylene and a compound a cyano group and a double bond, such as acrylonitrile, are especially preferred.

The diameter of the graphite continuous filament of the present invention comprising a graphite layer as the outer skin layer is selected so that a good pliability is retained. If the filament diameter is about 10 to about 20 μm, the pliability is very high. If the filament diameter is about 100 μm, the pliability is slightly degraded but the graphite filament retains such a pliability that the graphite filament can be used as an industrial material. The upper limit of the filament diameter permissible for an industrial material differs according to the crystallinity of graphite and the field in which the filament is used, but, if the filament diameter exceeds 1,000 μm, the pliability is poor. A composition known as a carbon-carbon composite is pre-, pared by depositing carbon on a woven fabric of carbon fibers. In this carbon-carbon composite, it is indispensable that carbon fibers should be bonded to one another through the deposited carbon. In contrast, in the fibrous composition of the present invention, it is indispensable that filaments should not be bonded to one another, and in this point, the graphite filament of the present invention is different from the conventional composition.

The process of the present invention comprises depositing easily graphitizable carbon on a flexible filament preferably according to the CVD method (such as gas phase thermal decomposition method) and calcining the carbon-deposited filament at a temperature of at least 2,500° C., preferably at least 3,000° C. The CVD method includes an internal heating method in which the substrate per se is heated and an external heating method in which heating is effected from the outside of the substrate. In the present invention, the two methods can be adopted, but the internal heating method is preferred. The internal heating method includes an induction heating method and a resistance heating method, and both can be adopted in the present invention. The CVD temperature differs according to the kind of the hydrocarbon used, but a temperature of about 700° to about 1,800° C. is ordinarily adopted and a temperature of 1,000° to 1,500° C. is preferred. CVD at a high temperature exceeding 2,000° C. is not always suitable for , formation of easily graphitizable soft carbon and is not preferred from the economical viewpoint.

The concentration of the hydrocarbon may be in a broad range. Namely, the partial pressure of the hydrocarbon may be in the range of 0.5 to 100 mmHg, preferably 1 to 30 mmHg. Of course, the concentration outside this range may be adopted. In the case where an inert gas is co-present with the hydrocarbon, the concentration of the hydrocarbon is ordinarily in the range of about 0.06 to about 20%. Of course, if the concentration is outside this range, a certain effect can be attained. Nitrogen and argon can be used as the inert gas. Furthermore, hydrogen may be co-present with the hydrocarbon, if necessary. The CVD time is changed according to other conditions, but ordinarily, a time of several minutes to scores of minutes is preferred. In order to deposit easily graphitizable carbon, it is preferred that the temperature and concentration be as low as possible and the reaction time be as long as possible. Furthermore, in order to promote the graphitization, it is possible to deposit a catalyst simultaneously with carbon. As the catalyst, there may be used boron, titanium, nickel and other compounds. The catalyst may be deposited after the CVD treatment by the impregnation method or the like. The CVD can be accomplished by passing a single filament through the reaction zone. Furthermore, a bundle of filaments may be passed through the reaction zone.

For example, a single filament or filament bundle is heated according to an appropriate method and is continuously passed through a furnace in which a stream of a hydrocarbon such as cyanoacetylene, dicyanoacetylene, benzene, toluene, xylene, naphthalene, heptane or cyclohexane is retained at an appropriate speed, whereby carbon is deposited on this filament substrate.

Furthermore, since the carbon filament is electrically conductive, the carbon filament is passed through the reaction zone of a hydrocarbon atmosphere while resistance-heating the carbon filament by applying an electric current through an electrode roller, whereby the hydrocarbon is deposited. The carbon thus deposited on the continuous filament is graphitized by calcining the continuous filament at a temperature of at least 2,500° C., preferably at least 3,000° C. The time required for the graphitization differs according to other conditions, but ordinarily, the graphitization time is about 10 minutes to about 60 minutes. Of course, a certain effect can be attained if the graphitization time is longer or shorter. The graphitization by the heat treatment can be performed batchwise or in a continuous manner. In case of the continuous treatment, the filament to be treated in continuously supplied to a reaction vessel through rolls. Heating is accomplished by a furnace of the external heating type generally called a Tammann furnace. Of course, a furnace of the , induction heating type may also be used.

The electric conductivity of the graphite continuous filament prepared according to the process of the present invention can be increased by intercalation. Of course, a highly electroconductive composition obtained by intercalation of the graphite continuous filament obtained according to the process of the present invention is included within the scope of the present invention. It is known that many compounds can be used for the intercalation. For example, there may be used alkali metals such as Li and Na, halogens such as chlorine and bromine, interhalogen compounds such as $IF_5$, metal halides such as $MgCl_5$ and $WCl_6$, acids such as nitric acid, sulfuric acid and $AsF_5$, metal-molecule compounds such as $Na\text{-}NH_3$, organic metal compounds such as K-naphthalene, and other compounds. Nitric acid is especially preferred because it is cheap and not toxic and the product is stable.

Various methods are known as the intercalation method (see, for example, Carbon, No. 11, page 171, 1982). For example, there may be adopted the gas phase reaction method, the mixing method, and the solution method.

Uses of the highly electroconductive graphite filament provided according to the present invention have been described at the beginning of the instant specification. These uses will now be described more in detail. The electric conductivity of the graphite filament provided according to the present invention is very high but the specific gravity is low. Accordingly, the highly electroconductive graphite filament of the present invention is suitable as an electroconductive material for which a light weight is required, for example, an electroconductive material for an air-plane. Moreover, if the highly electroconductive graphite filament of the present invention is used for a power-transmission line, the load of the wire on a post is reduced. Accordingly, the highly electroconductive graphite filament of the present invention is suitable as a power-transmission material. Since the electric conductivity of the outer skin layer is especially high, the highly electroconductive graphite material of the present invention is particularly suitable for transmission of an alternating current power which is influenced by the skin effect. Furthermore, since the electroconductive material provided according to the present ivnention has a high corrosion resistance, it is preferably used in the fields where corrosion is a problem.

The material of the present invention is preferably used at a high temperature where metals are fused. When the material of the present invention is used as an electroconductive material, it is used usually in the form of a bundle of electroconductive filaments, which is twisted or not twisted and is covered with a plastic insulating material. For this purpose, polyethylene, polyvinylidene chloride, polyvinyl chloride, nylon, Tetron and other thermoplastic materials may be used. Alternatively, a thermosetting resin such as an epoxy resin may be used. This electroconductive composition formed by covering the highly electroconductive graphite filament of the present invention with an insulating material should be interpreted to be included within the scope of the present invention.

The process of the present invention will now be described in detail with reference to the following examples.

EXAMPLE 1

Each of Thornel-P (carbon filament supplied by UCC, USA) and M-40 (carbon filament supplied by Toray Industries Inc., Japan) was passed through a quartz reaction tube having a diameter of 15 mm and a length of 45 cm in an argon atmosphere, and while the carbon filament was heated at 1,300° C. by applying electric current through electroconductive rollers, benzene was introduced under a partial pressure of 1 mmHg whereby carbon was deposited on the carbon filament. The residence time of the filament in the reaction tube was 10 minutes. The obtained filament was heat-treated at a temperature of 3,000° C. for 30 minutes in an argon current (the heat-treated filament obtained from Thornel-P is designated as "CVD-heat-treated Th" and the heat-treated filament obtained from M-40 is designated as "CVD-heat-treated M40" for brevity). The obtained, heat-treated filament was doped for 15 minutes with a vapor of concentrated nitric acid (the doped filament is designated as "doped Th" or "doped M-40" for brevity). For comparison, Thornel-P and M-40 were heat-treated in an argon atmosphere at 3,000° C. for 60 minutes (the heat-treated filaments are designated as "heat-treated Thonel" and "heat-treated M-40" for brevity).

The diameters and electric conductivities of the obtained filaments are shown in Table 1.

TABLE 1

| Filament | Diameter (μm) | Electric Conductivity (S/cm) |
|---|---|---|
| Thornel | 10 | 1,000 |
| M-40 | 6 | 800 |
| heat-treated Thornel | 10 | 2,000 |
| heat-treated M-40 | 6 | 1,200 |
| CVD-heat-treated Th | 40 | 15,000 |
| CVD-heat-treated M40 | 30 | 13,000 |
| doped Th | 51 | 250,000 |
| doped M-40 | 42 | 200,000 |

It is seen that even if Thornel or M-40 is calcined at a high temperature of 3,000° C., the improvement of the electric conductivity is small. It also is seen that the CVD-heat-treated filament and doped filament obtained according to the process of the present invention have a highly improved electric conductivity.

The X-ray diffractiometry of the thus-obtained filaments were carried out by using a rotor flex strong X-ray generator Model RU200 supplied by Rigaku Denki, a microdifractometer Model MDG2193D and a goniometer according to the transmission method using a Cu-Kα ray. The spacing was determined from the (0,0,2) diffraction line by using the obtained results. It was found that the spacing of heat-treated Thornel was 3.387 angstroms and the spacing of the CVD-heat-treated Thornel was 3.362 angstroms.

From the foregoing results, it is seen that even if Thornel is calcined at 3,000° C., the spacing is large and the graphitization is not advanced, whereas the spacing of the filament of the present invention is very small and the graphitization is advanced.

EXAMPLE 2

A bundle of carbon filaments each having a diameter of 10 μm and prepared by calcining meso-phase pitch at 2,000° C. was passed at a speed of 4 cm/min through a reaction tube of the external heating type having a diameter of 15 mm and a length of 60 cm, and a monomer shown below was deposited at a temperature indicated below in an argon current of one atmosphere. The deposition conditions were as shown in Table 2.

TABLE 2

| Run No. | Monomer | Concentration (%) | Reaction Temperature (°C.) |
|---|---|---|---|
| 1 | Benzene | 0.13 | 1,200 |
| 2 | Heptane | 0.5 | 1,600 |
| 3 | Acetylene | 0.2 | 1,200 |
| 4 | Cyclohexane | 0.2 | 1,300 |
| 5 | Naphthalene | 0.12 | 1,500 |
| 6 | Propagyl alcohol | 0.1 | 900 |
| 7 | Not deposited | — | — |

The obtained composition was calcined at an argon current at a temperature of 3,000° C. and the electric conductivity, filament diameter and strength of the obtained filament were measured. The obtained results are shown in Table 3.

TABLE 3

| Run No. | Electric Conductivity (S/cm) | Filament Diameter (μm) | Strength (kg/mm$^2$) |
|---|---|---|---|
| 1 | 14,000 | 30 | 61 |
| 2 | 11,000 | 15 | 80 |
| 3 | 14,000 | 25 | 60 |
| 4 | 12,000 | 20 | 71 |
| 5 | 11,000 | 18 | 90 |
| 6 | 12,000 | 20 | 95 |
| 7 | 1,500 | 10 | 150 |

The spacings of the products of Runs. Nos. 1 through 6 were in the range of from 3.362 to 3.363 angstroms and the spacing of the product of Run No. 7 was 3.388 angstroms.

EXAMPLE 3

The CVD-heat-treated Th obtained in Example 1 was subjected to the intercalation at room temperature for hours by using an intercalant shown below so as to improve the electric conductivity. The obtained results are shown in Table 4.

TABLE 4

| Run No. | Intercalant | Electric Conductivity (S/cm) |
|---|---|---|
| 1 | $FeCl_3$, gas phase | $1.1 \times 10^5$ |
| 2 | $NbCl_5$, saturated solution | $6.5 \times 10^4$ |
| 3 | $AlCl_3$, saturated solution | $9.0 \times 10^4$ |
| 4 | $SbF_5$, gas phase | $2.1 \times 10^5$ |
| 5 | $H_2SO_4$, liquid layer | $1.5 \times 10^5$ |
| 6 | $WCl_6$, saturated solution | $7.0 \times 10^4$ |
| 7 | $WF_6$, gas phase | $8.5 \times 10^4$ |

(The saturated solution was prepared by using nitromethane as the solvent.)

EXAMPLE 4

A carbon filament (M-40 supplied by Toray Industries) was passed through a quartz reaction tube having a diameter of 15 mm and a length of 45 cm in a nitrogen atmosphere, and while the filament was heated at 1,200° C. by electric heating through electroconductive rollers, a monomer indicated below was introduced under a partial pressure of 1 mmHg, whereby CVD of the monomer was effected on the carbon filament for 10 minutes. The obtained filament was heat-treated at 3,000° C. for 60 minutes in an argon current. The electric conductivity of the obtained filament is shown below.

| Monomer | Electric Conductivity (S/cm) |
|---|---|
| Cyanoacetylene | 16,000 |
| Dicyanoacetylene | 17,000 |
| Acrylonitrile | 15,500 |
| Chloroacrylonitrile | 15,500 |

The obtained filament was subjected to the doping or intercalation treatment in the same manner as described in Example 1 or 3. The obtained results are shown in Table 5 below.

| Monomer | Intercalant | Electric Conductivity (S/cm) |
|---|---|---|
| Cyanoacetylene | Nitric acid | 300,000 |
| | $FeCl_3$ | 200,000 |

-continued

| Monomer | Intercalant | Electric Conductivity (S/cm) |
|---|---|---|
| Acrylonitrile | Nitric acid | 250,000 |

EXAMPLE 5

A carbon filament (M-40 supplied by Toray Industries) was passed through a quartz reaction tube having a diameter of 15 mm and a length of 45 cm in a nitrogen atmosphere, and while the filament was heated at a temperature indicated below by electric heating through electroconductive rollers, a monomer indicated below was introduced under a partial pressure of 3 mmHg, whereby CVD was carried out on the carbon filament for 10 minutes. The obtained filament was heat-treated at 3,200° C. for 10 minutes in an argon current. The electric conductivity of the obtained filament is shown in Table 6 below.

TABLE 6

| Monomer | CVD Temperature (°C.) | Electric Conductivity (S/cm) |
|---|---|---|
| Cyanoacetylene | 700 | 8,000 |
| Cyanoacetylene | 1,200 | 17,000 |
| Cyanoacetylene | 1,800 | 17,000 |
| Cyanoacetylene | 2,000 | 7,000 |

It is seen that if the calcination temperature is too low, the electric conductivity is not sufficiently improved, and if the calcination temperature is too high, the consumption of energy for CVD is increased and the process is economically disadvantageous, and the electric conductivity is not sufficiently improved.

We claim:

1. A highly electroconductive graphite continuous filament comprising a carbon filament as a substrate and a graphite layer having a layer spacing d (0, 0, 2) of not larger than 3.363 angstroms as an outer skin layer, said graphite layer having an electrical conductivity of at least $1.1\times10^4$ (S/cm).

2. A highly electroconductive graphite continuous filament according to claim 1, which is obtained by a process comprising th steps of:

thermally decomposing at least one compound selected from the group consisting of aliphatic hydrocarbons, aromatic hydrocarbons, alicyclic hydrocarbons and derivatives thereof at a temperature of 1,100° to 1,600° C. and a pressure of 1 to 50 mmHg thereby depositing easily graphitizable carbon on a continuous carbon filament; and then, heat-treating the carbon-deposited continuous filament at a temperature of at least 2500° C. thereby graphitizing the easily graphitizable carbon.

3. A highly electroconductive graphite continuous filament according to claim 2, wherein said compound to be decomposed is benzene.

4. A highly electroconductive graphite continuous filament according to claim 2, wherein said compound to be decomposed is an organic compound having 3 to 6 carbon atoms and having a cyano group and a carbon-to-carbon triple bond, or an organic compound having 3 to 6 carbon atoms and having a cyano group and a carbon-to-carbon double bond, which is represented by the following formula:

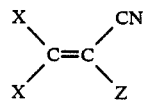

wherein X, Y and Z independently represent a hydrogen atom, a halogen atom, a cyano group or an alkyl group.

5. A highly electroconductive graphite continuous filament according to claim 2, wherein said compound to be decomposed is cyanoacetylene or dicyanoacetylene.

6. A highly electroconductive graphite continuous filament according to claim 2 wherein the deposition of easily graphitizable carbon is carried out by continuously passing said continuous carbon filament through an atmosphere of said heated thermally decomposed compound while applying voltage to said carbon filament to internally heat said carbon filament.

7. A highly electroconductive graphite continuous filament according to claim 1, which is covered with an insulating material.

8. An intercalated graphite continuous filament obtained by intercalation of a highly electroconductive graphite continuous filament comprising a continuous carbon filament as a substrate and a graphite layer having a layer spacing d (0, 0, 2) of not larger than 3.363 angstroms and an electrical conductivity of at least $1.1\times10^4$ (S/cm).

9. An intercalated graphite continuous filament according to claim 8 wherein said intercalation is carried out with nitric acid.

10. An intercalated graphite continuous filament according to claim 8 wherein said intercalation is carried out with ferric chloride.

11. An intercalated graphite continuous filament according to claim 8, which is covered with an insulating material.

* * * * *